United States Patent [19]

Lemisch et al.

[11] 4,190,287

[45] Feb. 26, 1980

[54] KNEE ABDUCTOR AND RESTRAINER

[76] Inventors: Ellen Lemisch, 711 West End Ave., New York, N.Y. 10025; Fredrik Rostock, 18 W. 70 St., Penthouse B, New York, N.Y. 10000

[21] Appl. No.: 919,814

[22] Filed: Jun. 28, 1978

[51] Int. Cl.[2] ..... A47C 31/00; A62B 35/00

[52] U.S. Cl. ..... 297/466; 297/467

[58] Field of Search ..... 297/427, 390, 384, 4

[56] References Cited

U.S. PATENT DOCUMENTS

| | | | |
|---|---|---|---|
| 2,650,654 | 9/1953 | Twiford | 297/427 |
| 2,656,875 | 10/1953 | Hutchinson | 297/4 |
| 3,136,581 | 6/1964 | Caballero | 297/384 |
| 3,218,103 | 11/1965 | Boyce | 297/384 |
| 3,245,382 | 4/1966 | Easley et al. | 297/384 X |

FOREIGN PATENT DOCUMENTS

| | | | |
|---|---|---|---|
| 1238617 | 4/1967 | Fed. Rep. of Germany | 297/384 |

*Primary Examiner*—James T. McCall

*Attorney, Agent, or Firm*—Eugene E. Geoffrey, Jr.

[57] ABSTRACT

A knee abductor and restrainer for use on chairs such as wheel chairs and the like to aid in maintaining a patient in an upright position which includes a seat portion having straps for holding it on to the seat of a chair, a pair of restraining and supporting straps secured to the seat portion and extending upwardly between the patient's legs and partially around the body, the restraining straps having fastening straps extending from the ends thereof for attachment about the back of the chair in order to retain the patient in position and at the same time afford adequate leg movement.

6 Claims, 8 Drawing Figures

KNEE ABDUCTOR AND RESTRAINER

This invention relates to a supporting and restraining aid and knee abductor for persons unable to sit securely in a conventional chair or wheel chair as the case may be.

In many cases persons may be incapacitated to an extent rendering them unable to sit comfortably in an upright position and they are often unable to prevent themselves from sliding forward and even falling from the chair. In the case of a wheel chair, this interfers with the person's ability to guide the chair. With this invention, the body is maintained erect so that the person can guide the chair and his legs are also afforded maximum freedom.

Accordingly, one object of the invention resides in the provision of a novel and improved supporting and restraining aid for patients which may be quickly and easily affixed to any type of chair and afford the patient maximum security, seating balance and comfort.

Another object of the invention resides in the provision of a novel and improved supporting and restraining aid for patients which is characterized by its simplicity, ease of installation and laundering, and relatively low cost.

Still another object of the invention resides in the provision of a novel and improved seating aid for patients.

The knee abductor and restrainer for patients in accordance with this invention comprises a seat portion having straps extending from the sides thereof for fastening it to a chair, a pair of restraining members of a padded material secured to the central forward edge of the seat portion and adapted to extend about the patient's legs and be attached about the back of the chair. In this way, the restraining members hold the legs apart and extend about the body to prevent the patient from sliding forwardly.

The above and other objects and advantages of the invention will become more apparent from the following description and accompanying drawings forming part of this application.

IN THE DRAWINGS

Figure 2:
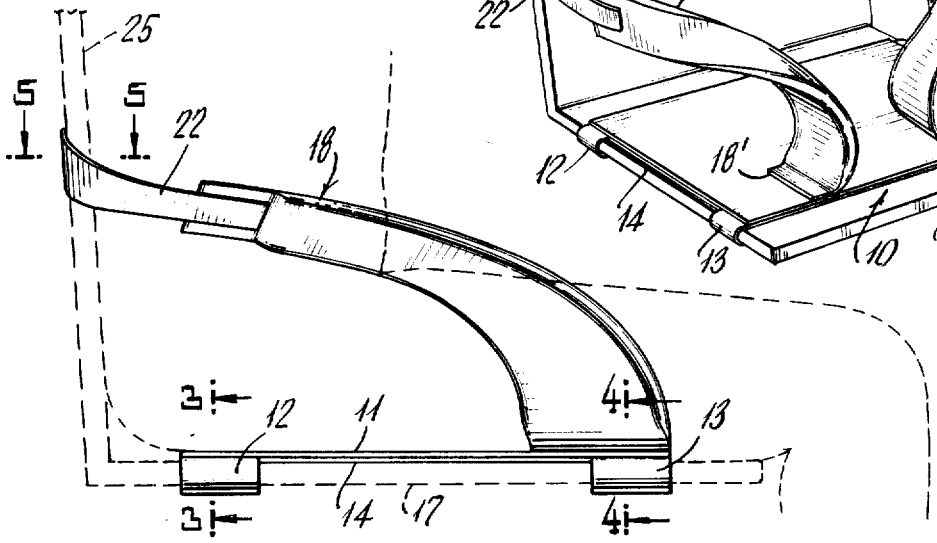
FIG. 2 is a side elevational view of the structure shown in FIG. 1.
Figure 3:
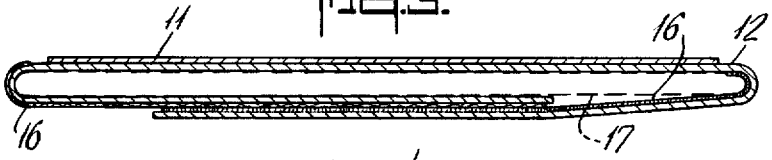
Figure 4:
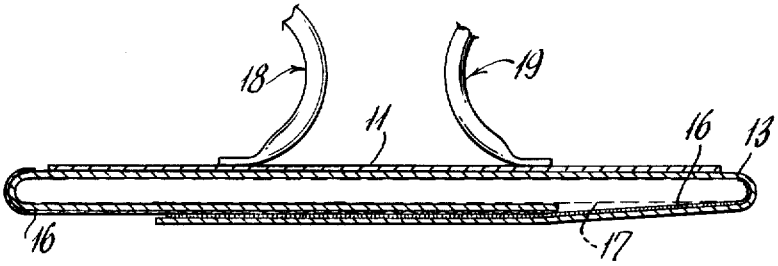
Figure 5:
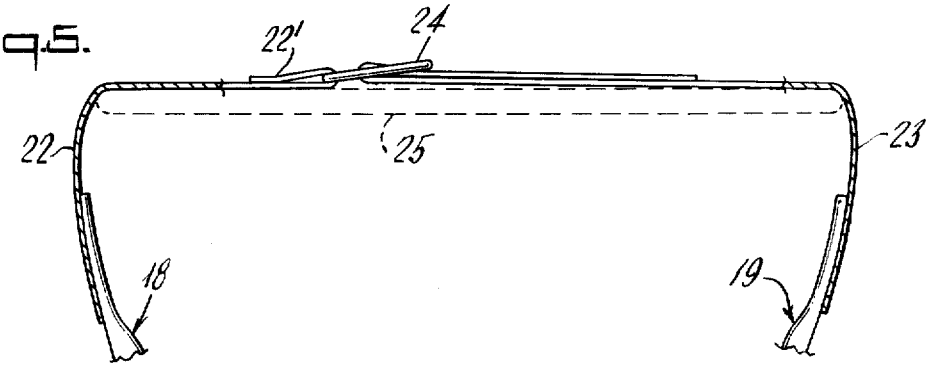

FIGS. 3, 4 and 5 are cross-sectional views of FIG. 2 taken along the lines 3—3, 4—4 and 5—5 thereof.

Figure 1:
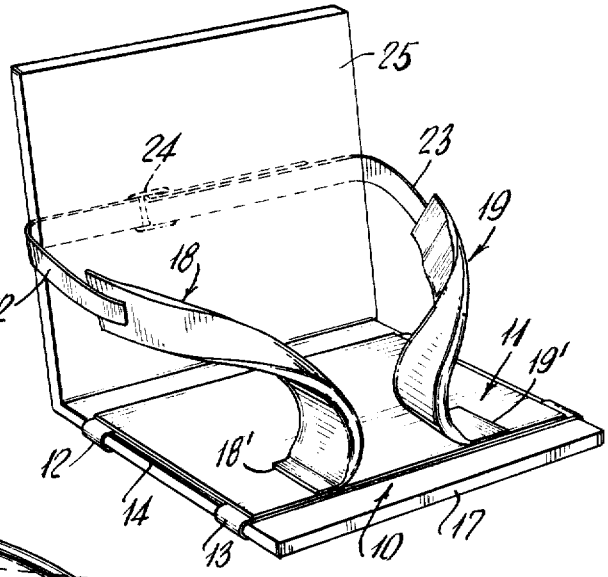
FIG. 1 is a perspective view of the knee abductor and restrainer in accordance with the invention and in position on a chair.
Figure 6:
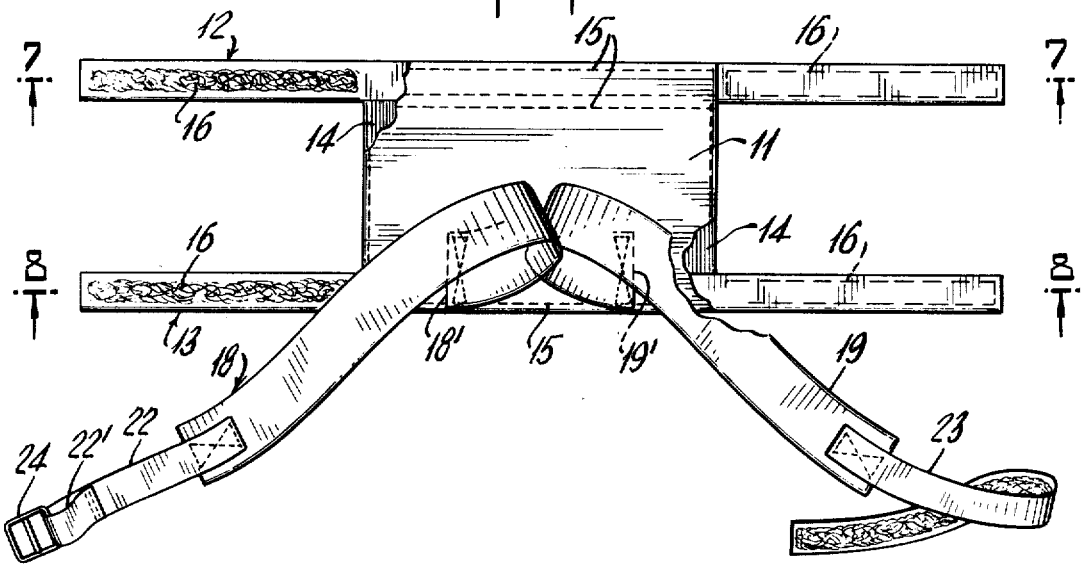
Figure 7:
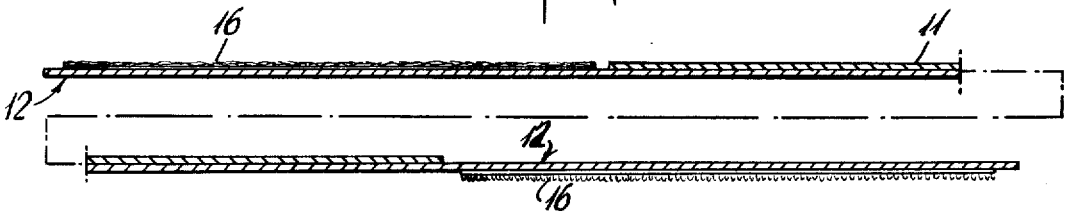
Figure 8:
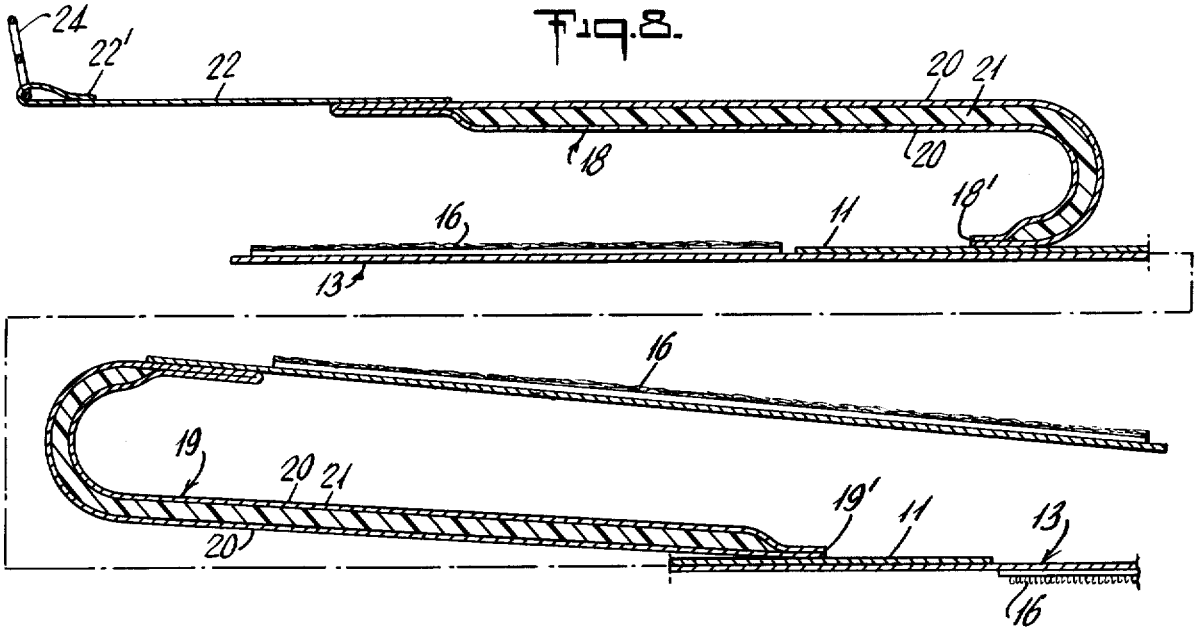

FIG. 6 is a plan view of the knee abductor and restrainer as illustrated in FIG. 1, and;

FIGS. 7 and 8 are cross-sectional views of FIG. 6 taken along the lines 7—7 and 8—8 thereof.

The knee abductor and restrainer in accordance with the invention provides a comfortable and secure means for holding a patient in a chair, such as a wheel chair or the like. With this arrangement, a patient unable to maintain an upright position is provided with sufficient support to enable him to more accurately guide a wheel chair and at the same time have relatively free use of his legs.

More specifically and with reference to the drawings, the knee abductor and restrainer is generally denoted by the numeral 10 and comprises a seat portion 11 having straps 12 and 13 secured along the rear and front edges of the seat portion 11. If desired, an underlying layer 14 may be applied to the underside of the seat portion 11 and between the straps 12 and 13 in order to compensate for the thickness of the straps and thus afford additional comfort for the patient. With reference to FIG. 6, it will be noted that the straps 12 and 13 are sewn to the seat portion 11 by stitching 15. The upper side of the straps extending to the left of the seat portion 11 are provided with strips of a gripping type material 16 while the strap portions extending to the right of the seat portion as viewed in FIG. 6 have similar strips of material 16 secured to the underside thereof. The strips of material 16 are each formed with a plurality of minute hook-like elements so that when two strips are brought into contact beneath the chair seat 17 as viewed in FIGS. 1 through 4 the strips 16 will adhere one to the other. One such type of material suitable for this purpose is manufactured and sold under the trademark Velcro. It is obvious, however, that in place of the strips of material 16 suitable buckling means can be utilized to the secure seat portion 11 firmly to the chair seat 17.

The patient is held in position in the chair by a pair of padded restraining straps generally denoted by the numeral 18 and 19. Each of the straps, 18 and 19, are provided with outer layers 20 of a relatively strong resilient fabric and an inner layer 21 of a soft material such as sponge rubber, polyurethane foam or the like. The straps 18 and 19 are sewn or otherwised secured to the seat portion 11 as illustrated more specifically in FIGS. 1 and 6. The edges 18' and 19' are positioned in spaced relationship on the seat portion 11 and face outwardly. The distance between the edges 18' and 19' is adjusted so that the patient's legs will be held apart and at the same time provide ample room for the upper leg portions so that they will not be held too tightly against the side of the wheel chair or other chair in which the patient is seated. The outer or free ends of the supporting and restraining straps 18 and 19, each have fastening straps 22 and 23 secured thereto. In the illustrated embodiment of the invention the strap 22 has a looped portion 22' for retaining a buckle 24.

With this arrangement, a patient is seated in the chair and the restraining straps 18 and 19 are positioned between the legs. The straps are then placed about the patient's legs and body as illustrated in FIGS. 1 and 2 and the fastening straps 22 and 23 are then brought about the chair back 25 and connected one to the other by the buckle 24. With this arrangement the supporting and restraining straps 18 and 19 can be made tight enough to retain the patient in position on the chair and still permit adaquate freedom of movement of the legs.

While only one embodiment of the invention has been illustrated and described, it is understood that alterations, changes and modifications may be made without departing from the true scope and spirit of the invention.

What is claimed is:

1. A knee abductor and restrainer for use on chairs having seats and backs such as wheel chairs and the like comprising a pair of flexible restraining straps, means for securing said straps to the forward portion of the chair seat and in spaced relationship one to the other, said straps extending upwardly about the inner portions of the legs of the user, diagonally across the legs and rearwardly about the body of the user and embracing the abdomen to maintain the legs of the user in a separated position and means on the ends of the straps for attaching them to the chair back whereby said straps extend about the legs and body of the user to maintain the user in an upright position while permitting use of the legs.

2. A knee abductor and restrainer according to claim 1 including a seat portion, means for securing said seat portion to the chair seat and means securing said straps to the forward edge of said seat portion.

3. A knee abductor and restrainer according to claim 2 wherein said means for securing said seat portion to said chair seat comprises at least two seat straps attached to said seat portion along the forward and rear edges thereof and extending from the sides of said seat portion and means on at least one end of each of said seat straps for engaging the other end of the corresponding strap beneath the chair seat for holding said seat portion securely in position on said chair seat.

4. A knee abductor and restrainer according to claim 1 wherein said means for attaching said restraining straps includes a fastening strap secured to and extending from each of said restraining straps, said fastening straps extending about said chair back and one of said fastening straps including means for attaching it to the other of said fastening straps.

5. A knee abductor and restrainer according to claim 4 including a seat portion means for securing said seat portion to the chair seat and means securing said straps to the forward edge of said seat portion.

6. A knee abductor and restrainer according to claim 5 wherein said means for securing said seat portion to said chair seat comprises at least two seat straps attached to said seat portion along the forward and rear edges thereof and extending from the sides of said seat portion and means on at least one end of each of said seat straps for engaging the other end of the corresponding strap beneath the chair seat for holding said seat portion securely in position on said chair seat.

* * * * *